United States Patent [19]

Tomlin

[11] 4,120,164

[45] Oct. 17, 1978

[54] UNDERGROUND ROADWAY OR TUNNEL SUPPORT

[75] Inventor: Malcolm George Tomlin, Burton-on-Trent, England

[73] Assignee: Coal Industry (Patents) Limited, London, England

[21] Appl. No.: 820,064

[22] Filed: Jul. 28, 1977

[30] Foreign Application Priority Data

Aug. 4, 1976 [GB] United Kingdom ..... 32452/76

[51] Int. Cl.[2] ..... E21D 17/00

[52] U.S. Cl. ..... 405/289

[58] Field of Search ..... 61/45 F, 45 R, 45 C, 61/50, 35

[56] References Cited

U.S. PATENT DOCUMENTS 3,396,545 8/1968 Lamberton ..... 61/45 R X

FOREIGN PATENT DOCUMENTS 2,503,014 7/1976 Fed. Rep. of Germany ..... 61/45 C

A85,822 9/1965 France ..... 61/45 F 1,034,537 6/1966 United Kingdom ..... 61/45 F

*Primary Examiner*—Jacob Shapiro

*Attorney, Agent, or Firm*—James C. Wray

[57] ABSTRACT

A method and apparatus is provided for supporting an underground mine roadway or tunnel having a series of spaced rigid support members installed along the roadway or tunnel, the rigid support members being erected in turn adjacent to newly exposed mine or rock surface as the roadway or tunnel is extended. Deformable bags are arranged between the rigid support members and the adjacent mine or rock surface. In addition deformable limbs extend from the last installed support towards the next support to be erected, the bags and the containers being filled with flowable material including cement and a conveying medium.

10 Claims, 4 Drawing Figures

UNDERGROUND ROADWAY OR TUNNEL SUPPORT

Figure 1:
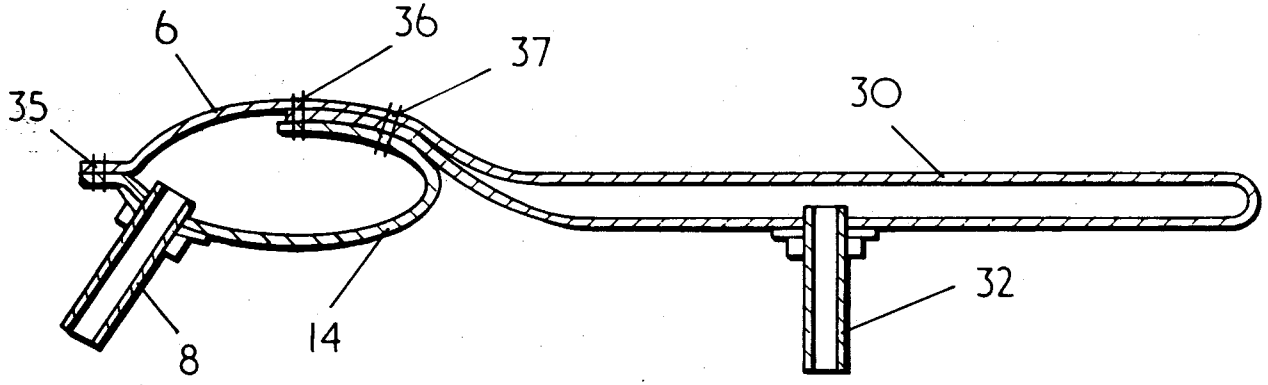

This invention relates to underground roadway or tunnel supports and in particular to methods of and apparatus for underground roadway or tunnel supports wherein series of rigid support members or arches are set adjacent to mine or rock surfaces to be supported.

Unfortunately, with present roadway or tunnel supports there tends to be at best only point contact between a set rigid support member or arch and the mine or rock surface. Consequently, substantial portions of the so called supported mine or rock surface can move and break away from the supported portions before being restrained by the erected rigid support member. Thus, the prior used roadway supports have the disadvantage that they tend not to give sufficient initial support to the mine surface.

In order to try and obtain sufficient initial support to reduce movement and breakage of the mine surface it has been proposed to install flexible bag containers between the erected rigid support members and the adjacent mine surface and to fill the flexible bag containers with flowable material so that the void existing between each installed rigid support member and the adjacent mine or rock surface is filled. Unfortunately, although such a proposal may overcome or reduce the disadvantages arising from insufficient initial support it creates other disadvantages associated with supporting lagging required to cover the space between adjacent rigid support members.

An object of the present invention is to provide improved underground roadway or tunnel support which tends to overcome the above mentioned disadvantage and which tends to provide adequate lagging in the space between adjacent rigid support members.

According to one aspect of the present invention a method of supporting an underground roadway or tunnel comprises installing a series of spaced rigid support members along the roadway or tunnel, the rigid support members being erected in turn adjacent to newly exposed mine or rock surface as the roadway or tunnel is extended, locating deformable container means in at least portions of voids existing between the erected rigid support members and adjacent portions of the mine or rock surface, filling the deformable container means with flowable material such that the deformable container means is urged into contact with said adjacent portions of the mine or rock surface filling at least portions of the voids which previously existed between the rigid support members and the adjacent portions of the mine or rock surface and extending deformable limb means associated with the last installed deformable container means towards a newly erected rigid support member such that the limb means is inserted between the newly erected rigid support member and an adjacent portion of the mine or rock surface and is retained in the extended position when the next installed deformable container means associated with said newly erected rigid support member is filled with flowable material.

Preferably, the limb means is secured to the associated deformable container means.

Advantageously, the limb means is a container and in which case when it is retained in the forwardly extended position it is filled with flowable material.

According to another aspect of the present invention apparatus for carrying out the above defined method comprises a deformable container arrangeable around an erected rigid support member, inlet means for introducing flowable material into the deformable container, and a deformable limb secured to the deformable container and extendable, in use, towards a newly erected rigid support member.

Conveniently, the deformable container comprises outlet means for discharging from the deformable container a portion of the flowable material which constituted a conveying medium.

Preferably, the limb container has inlet means separate from those associated with the deformable container.

Advantageously, each container has a wall which is impervious to the non conveying medium portion of the flowable material and which restricts or limits expansion of the container.

Figure 2:
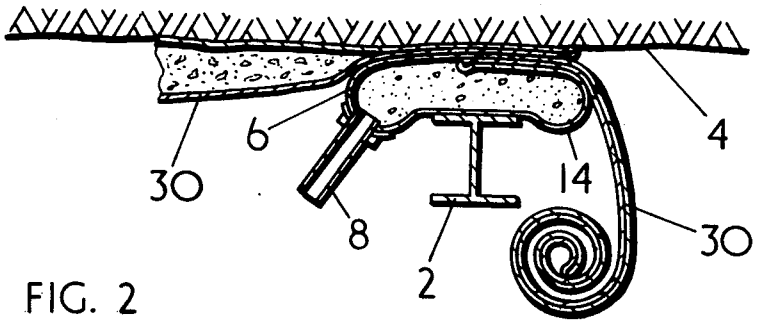
Figure 3:
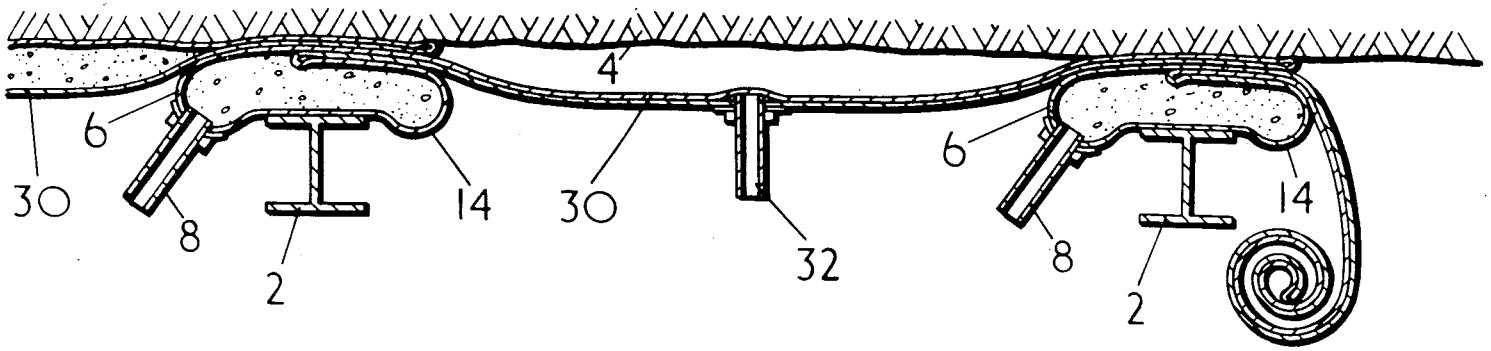
Figure 4:
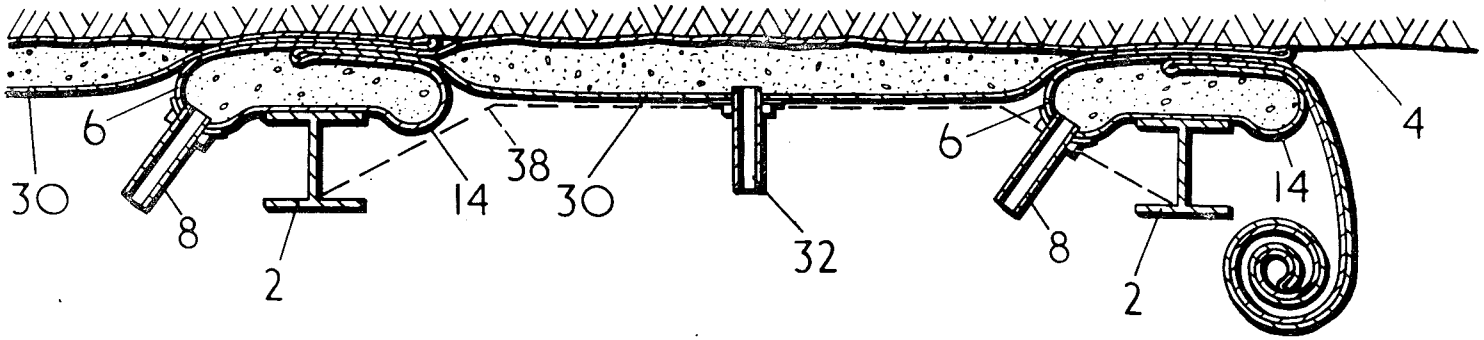

By way of example only, one embodiment of the present invention will be described with reference to the accompanying drawings, in which:

FIG. 1 is a diagrammatic sectional view through apparatus constructed in accordance with one aspect of the present invention; and FIGS. 2, 3 and 4 are diagrammatic sectional views similar to FIG. 1 and illustrating different stages of installations.

In an underground coal mine, roadways are excavated adjacent to a longwall face in a coal seam which has been recently extracted. Each roadway is supported by installing a series of spaces rigid support members or arches 2 (see FIGS. 2, 3 and 4) along the roadway, the rigid support members being erected in turn adjacent to a newly exposed mine or rock surface 4 as the roadway is extended. When a rigid support member 2 is newly erected, deformable container means in form of a collapsed deformable bag container 6 is located in at least a portion of the void existing between the newly erected rigid support member and adjacent portions of the mine surface 4. The deformable bag container is then filled with flowable material via inlet means 8 connectable to a feed pipe (not shown) and sealably mounted through wall 14 of the bag container 6. The feed pipe is fed with flowable material from a pump (not shown) situated in the roadway at some distance from the support currently being installed. A non-return valve (not shown) is provided on the end of the inlet means within the bag container.

The flowable material includes for example, water which constitutes a conveying medium and rapidly setting cement which causes the flowable material to set quickly once the bag container is filled.

The bag container 6 is provided with outlet means constituted partly by holes in the wall 14 which thereby is porous to the previously mentioned liquid conveying medium. The wall 14 is impervious to the non conveying portion of the flowable material including the cement and therefore tends to retain the solids within the bag container. In addition, the wall 14 restricts or limits expansion of the container. Liquid conveying medium flowing through the porous wall is allowed to flow through outlets in the bottom of the bag container. Typically, the wall 14 is made from a woven fabric which may be polyester based.

A deformable limb container 30 is secured to the bag container 6. The limb container is of similar construction to the bag container 6 and has inlet means 32 (not shown on the coiled limb container in FIGS. 2, 3 and 4) similar to the inlet means 8, previously discussed. In FIG. 1 it can be seen that the bag and limb containers 6 and 30 are formed by sealably stitching two wall layers 14 together along seams 35, 36 and 37.

FIGS. 2, 3 and 4 illustrate the operational sequence for installing a support in accordance with the present invention. As seen in FIG. 2 the bag container 6 is inserted around the newly erected rigid support member, or arch 2 with the adjacent end of the limb container 30 associated with the last previously installed support (not shown) tucked between the collapsed bag container and the mine or rock surface. The bag container is then filled with flowable material expanding to fill at least a portion of the void previously existing between the rigid support member or arch and the adjacent mine surface and trapping or captivating the end of the limb container 30 in an extended position. A removable wire mesh mat 38 is then located within the flanges of the newly erected member of arch 2 and of the last previously installed support so as to retain the limb container 30 in a desired position adjacent to the mine surface 4. The limb container 30 is then filled with flowable material through its inlet means. This is the stage of installation reached in FIG. 2.

When the flowable material in the limb container is set the wire mesh mat 38 is removed and carried forwards towards the next support to be installed.

In FIG. 3 the roadway has been extended further and another rigid support member or arch 2 erected, a deformable bag container 6 being inserted in the void around the member or arch before being filled with flowable material. As with the installing of the previously discussed support the limb container 30 is extended forwardly and trapped or captivated between the filled bag container and the mine surface. This is the stage reached in FIG. 3.

Finally, the previously mentioned wire mesh mat 38 which has been carried forward from the last installed set limb container is located within the flanges of the member or arch currently being installed and the previously installed member or arch before the limb container is filled with flowable material, the wire mesh mat ensuring that the filled limb container is maintained in contact with the mine surface which thereby tends to be adequately supported and no further lagging is required. The inlet means 8 and 32 pass through holes in the wire mesh mat.

Each time the roadway is extended sufficiently for a further support to be installed the procedure is repeated. Thus, the roadway tends to be effectively supported and lagged all around its exposed mine or rock surface with the support tending to supportably contact all or a large proportion of the mine or rock surface. As the flowable material includes rapidly setting cement efficient support of the newly exposed mine surface tends to be achieved rapidly. Thus, breakage and unrestrained movement of the mine surface tends to be avoided or reduced to a minimum or acceptable amount.

In a further embodiment of the invention the outlet means comprises outlet pipes through the container wall.

In a still further embodiment of the invention at least one of the containers comprises a wall having an inner and an outer skin.

I claim:

1. A method of supporting an underground roadway or tunnel comprising installing a series of spaced rigid support members along the roadway or tunnel, the rigid support member being erected in turn adjacent to newly exposed mine or rock surface as the roadway or tunnel is extended, locating deformable container means in at least portions of voids existing between the erected rigid support members and adjacent portions of the mine or rock surface, filling the deformable container means with flowable material such that the deformable container means is urged into contact with said adjacent portions of the mine or rock surface filling at least portions of the voids which previously existed between the rigid support members and the adjacent portions of the mine or rock surface and extending deformable limb means associated with the last installed deformable container means towards a newly erected rigid support member such that the limb means is inserted between the newly erected rigid support member and an adjacent portion of the mine or rock surface and is retained in the extended position when the next installed deformable container means associated with said newly erected rigid support member is filled with flowable material.

2. A method as claimed in claim 1, in which the limb means is secured to the associated deformable container means.

3. A method as claimed in claim 2, in which the limb means is constituted by container means.

4. A method as claimed in claim 3, in which when the limb container means is retained in the forwardly extended position it is filled with flowable material.

5. Apparatus for supporting an underground roadway or tunnel having a series of spaced rigid support members installed along the roadway or tunnel, the rigid support members being erected in turn adjacent to newly exposed mine or rock surface as the roadway or tunnel is extended, comprising a deformable container arrangeable around an erected rigid support member, inlet means for introducing flowable material into the deformable container, and a deformable limb secured to the deformable container and extendable, in use, towards a newly erected rigid support member.

6. Apparatus as claimed in claim 5, in which the deformable container comprises outlet means for discharging from the deformable container a portion of the flowable material constituting a conveying medium.

7. Apparatus as claimed in claim 6, in which the deformable limb is a container, inlet means for the deformable limb container being provided separate from the inlet means associated with the first mentioned deformable container.

8. Apparatus as claimed in claim 7, in which each container has a wall which is impervious to the non conveying medium portion of the flowable material and which restricts or limits expansion of the container.

9. The method as claimed in claim 3 further comprising filling the deformable limb container through an inlet separate from an inlet for the deformable container means.

10. The method as claimed in claim 9 further comprising discharging a portion of the flowable material constituting a conveying medium through walls of the container means which are impervious to the non-conveying medium portion of the flowable material and which restrict or limit expansion of the container.

* * * * *